US005490802A

United States Patent [19]

Plyler et al.

[11] Patent Number: 5,490,802

[45] Date of Patent: Feb. 13, 1996

[54] SECONDARY TERMINAL LOCK PLUG THROUGH STUFFER

[75] Inventors: Robert G. Plyler, Vienna, Ohio; Terry A. Rice, Canton; Chong H. Yi, Deaborn, both of Mich.

[73] Assignee: United Technologies Automotive, Inc., Dearborn, Mich.

[21] Appl. No.: 201,217

[22] Filed: Feb. 24, 1994

[51] Int. Cl.[6] ..... H01R 13/436

[52] U.S. Cl. ..... 439/752

[58] Field of Search ..... 439/752, 595

[56] References Cited

U.S. PATENT DOCUMENTS

| | | | |
|---|---|---|---|
| 3,824,523 | 7/1974 | McGhee | 439/595 |
| 3,838,382 | 9/1974 | Sugar | 439/595 |
| 3,941,444 | 3/1976 | Bruni et al. | 439/595 |
| 3,982,805 | 9/1976 | Irie | 439/595 |
| 4,127,314 | 11/1978 | Hasimoto | 439/595 |
| 4,311,355 | 1/1982 | Plyler et al. | 439/595 |
| 4,571,017 | 2/1986 | Fujita | 439/595 |
| 4,660,915 | 4/1987 | Mantik | 439/595 |
| 4,694,214 | 9/1987 | Stewart, Sr. | 310/239 |
| 4,697,862 | 10/1987 | Hasircoglu | 439/404 |
| 4,714,437 | 12/1987 | Dyki | 439/595 |
| 4,784,617 | 11/1988 | Oda | 439/595 |
| 4,797,116 | 1/1989 | Isohata et al. | 439/595 |
| 4,802,867 | 2/1989 | Palmer | 439/595 |
| 4,806,123 | 2/1989 | Konishi et al. | 439/595 |
| 4,826,452 | 5/1989 | Sian et al. | 439/595 |
| 4,891,021 | 1/1990 | Hayes et al. | 439/752 |
| 4,900,271 | 2/1990 | Colleran et al. | 439/595 |
| 4,946,398 | 8/1990 | Takenouchi et al. | 439/752 |
| 4,973,266 | 11/1990 | Bullard | 439/589 |
| 5,059,142 | 10/1991 | Ohta et al. | 439/752 |
| 5,071,373 | 12/1991 | Nagasaka et al. | 439/752 |
| 5,120,234 | 6/1992 | Mergless | 439/357 |
| 5,123,866 | 6/1992 | Endo et al. | 439/752 |
| 5,244,421 | 9/1993 | Jinno et al. | 439/752 |
| 5,288,243 | 2/1994 | Mergless | 439/357 |
| 5,292,261 | 3/1994 | Hirano et al. | 439/752 |

FOREIGN PATENT DOCUMENTS

| | | |
|---|---|---|
| 0518361A3 | 12/1992 | European Pat. Off. . |
| 0591950A2 | 4/1994 | European Pat. Off. . |
| 4030621A1 | 4/1991 | Germany . |

*Primary Examiner*—Gary F. Paumen
*Attorney, Agent, or Firm*—Harness, Dickey & Pierce

[57] ABSTRACT

An electrical connector assembly having a terminal stuffer member for securely maintaining a plurality of terminal members within a connector body. The terminal stuffer member includes a plurality of flexible locking arm members. The connector body includes a plurality of openings adapted to slidably receive a corresponding plurality of terminal members therein. At least one wall portion of the connector body includes a plurality of recessed portions associated with the openings for the terminal members, with each of the recessed portions having a ramped portion associated therewith. When the terminal stuffer member is slidably inserted into a first, preloaded position, the locking arm members are slidably received within the recessed portions and therefore do not interfere with the openings into which the terminal members are inserted. Accordingly, the terminal members may be inserted into the connector body when the terminal stuffer member is in the preloaded position. When the terminal member is further slidably engaged into a second, locked position with the connector body, the ramped portions urge the locking arm members outwardly into abutting engagement with a portion of each terminal member, thus securely holding the terminal member within the connector body. In the preferred embodiments a pair of flexible latching arm members are formed on the terminal stuffer member.

20 Claims, 4 Drawing Sheets

SECONDARY TERMINAL LOCK PLUG THROUGH STUFFER

BACKGROUND OF THE INVENTION

1. Technical Field

This invention relates to electrical connector assemblies, and more particularly to an electrical connector assembly for lockably securing a terminal member such that an external force applied to the terminal member will not cause the terminal member to become dislodged or otherwise disengaged from the connector assembly, thereby causing a break in electrical connection between the terminal member and an external terminal element.

2. Discussion

Electrical connector assemblies are used in a wide variety of applications, and particularly in automotive applications, where it is necessary to electrically interconnect a plurality of electrical cables to perform various functions. One drawback with many prior developed electrical connectors, however, is their inability to firmly secure a terminal member therein when the terminal member is subjected to a force, such as a pulling force, from an electrical conductor secured to the terminal member. In such instances, the movement of the terminal member within the connector may cause a temporary break in the electrical contact between the terminal member and another terminal blade inserted within the terminal member. More severe pulling forces on the terminal member may cause the member to be partially or completely dislodged from the connector body. In either event, even a momentary break in the electrical connection between the terminal member within the connector and a terminal blade engaged with the terminal member may result in spurious operation of an electrically driven device or an electrical circuit associated with the connector.

Prior developed connector assemblies have attempted to address the above described problems by incorporating an additional member into an electrical connector assembly which is engaged with the assembly so as to more positively lock the terminal member within the connector body of the connector assembly. These attempts have provided other drawbacks, however, in that the external members have projected into the openings in the terminal body into which the terminal members are inserted, thus making insertion of the terminal members during assembly more difficult.

Still another drawback of prior developed connector assemblies is the inability to consistently determine if the terminal member is fully seated within the connector assembly. Prior attempts to incorporate some form of stuffer member have been met with problems in that a terminal member which is not fully seated within a connector body will not allow the stuffer member to be coupled to the connector body as the stuffer will not be in proper alignment to interengage the terminal member. Thus, even one terminal member which is unseated to a small degree can impede coupling of the stuffer member, thus requiring all of the terminal members to be re-checked and the mis-positioned terminal member to be re-seated.

Accordingly, it is a principal object of the present invention to provide an electrical connector assembly which more securely holds a terminal member therewithin when the terminal member is subjected to external pulling or pushing forces by an electrical conductor electrically secured to the terminal member.

It is yet another object of the present invention to provide an electrical connector assembly having an external member which may be lockably engaged with a connector body of the electrical connector assembly to help maintain a terminal member firmly seated within the connector body.

It is still another object of the present invention to provide an electrical connector assembly having an independent terminal stuffing member which may be lockably engaged with a connector body of the assembly to firmly maintain a terminal member seated within the connector body in spite of external pushing or pulling forces exerted on the terminal member by a conductor secured thereto or an external terminal blade.

It is still another object of the present invention to provide a terminal stuffer for an electrical connector assembly which, when partially inserted into the connector assembly, does not interfere with insertion of a terminal member into a terminal receiving opening in a connector body of the assembly, and consequently does not increase the force required to physically insert the terminal member into the connector body during assembly.

It is yet another object of the present invention to provide an electrical connector assembly having an independent terminal stuffer member which may be lockably engaged to a connector body of the assembly such that the terminal stuffer member is not readily disengageable from the connector body once coupled to the connector body.

It is another object of the present invention to provide an electrical connector assembly having a terminal stuffer member which operates to cause one or more terminal members which are not completely seated within a connector body of the assembly to be properly seated within the connector body as the terminal stuffer member is urged into locking engagement with the connector body.

It is another object of the present invention to provide an electrical connector assembly having an external terminal stuffer member which may be constructed from widely available materials, such as plastic, to form a relatively low cost electrical connector assembly particularly well suited to automotive application.

SUMMARY OF THE INVENTION

The above and other objects are accomplished by an electrical connector assembly having a terminal stuffer member in accordance with preferred embodiments of the present invention. The assembly includes a connector body having at least one opening formed therein adapted to receive an external terminal member slidably therein. A recess is formed in a portion of the connector adjacent the opening for the terminal member. The recess further includes a ramp portion associated therewith. An external terminal stuffer member having a depending locking arm member is at least partially insertable into the opening into a first, preloaded position. In this position an external terminal member may be slidably inserted into the opening without interference from the locking arm portion. Once the terminal member is inserted, further engagement of the terminal stuffer member relative to the connector body to a second, locked position causes the locking arm portion to be urged outwardly by the ramp portion into abutting engagement with a portion of the terminal member. In this manner the terminal stuffer member prevents the terminal member from being dislodged from the connector body in response to a pulling or pushing force exerted by an electrical conductor secured to the terminal member or an external terminal blade. The terminal stuffer member provides the additional advantage of causing any one or more terminal members which happen to be not completely seated within the connector body to be urged into a fully seated position as the terminal stuffer member is urged in its locked position relative to the connector body.

In a preferred embodiment of the present invention the terminal stuffer member and connector body each include means for cooperating to lockably engage once the terminal stuffer member has been inserted into the second, locked position. In another preferred embodiment a pair of guide members are formed on the connector body and cooperate with at least one flexible latching arm member formed on the terminal stuffer member to help guide the terminal stuffer member into engagement with the connector body when the terminal stuffer member is slidably inserted into the first, preloaded position. The guide members further help the flexible arm member from being moved away from the connector body, to thus maintain the terminal stuffer member in the second, locked position, via a pair of overhanging shoulder members.

It is a principal advantage of the preferred embodiments of the present invention that the terminal stuffer member may be secured to the connector body in the first, preloaded position without interfering with the insertion of a terminal member into the opening in the connector body. Thus, during assembly, when the terminal stuffer member is secured to the connector body in the first, preloaded position, the terminal member may still be completely inserted into the opening in the connector body. Only after sliding engagement of the terminal stuffer member into the second, locked position relative to the connector body is the locking arm portion of the terminal stuffer member urged into the opening in the connector body into which the terminal member is slidably received. It is still another important advantage that the stuffer member may still be coupled to the connector body even though one or more terminal members are not quite seated completely within the connector body. In this event, urging the terminal stuffer member into locking engagement with the connector body will also serve to urge any one or more slightly unseated terminal members into a fully seated position.

BRIEF DESCRIPTION OF THE DRAWINGS

The various advantages of the present invention will become apparent to one skilled in the art by reading the following specification and subjoined claims and by referencing the following drawings in which:

DETAILED DESCRIPTION OF THE PREFERRED EMBODIMENT

Figure 1:
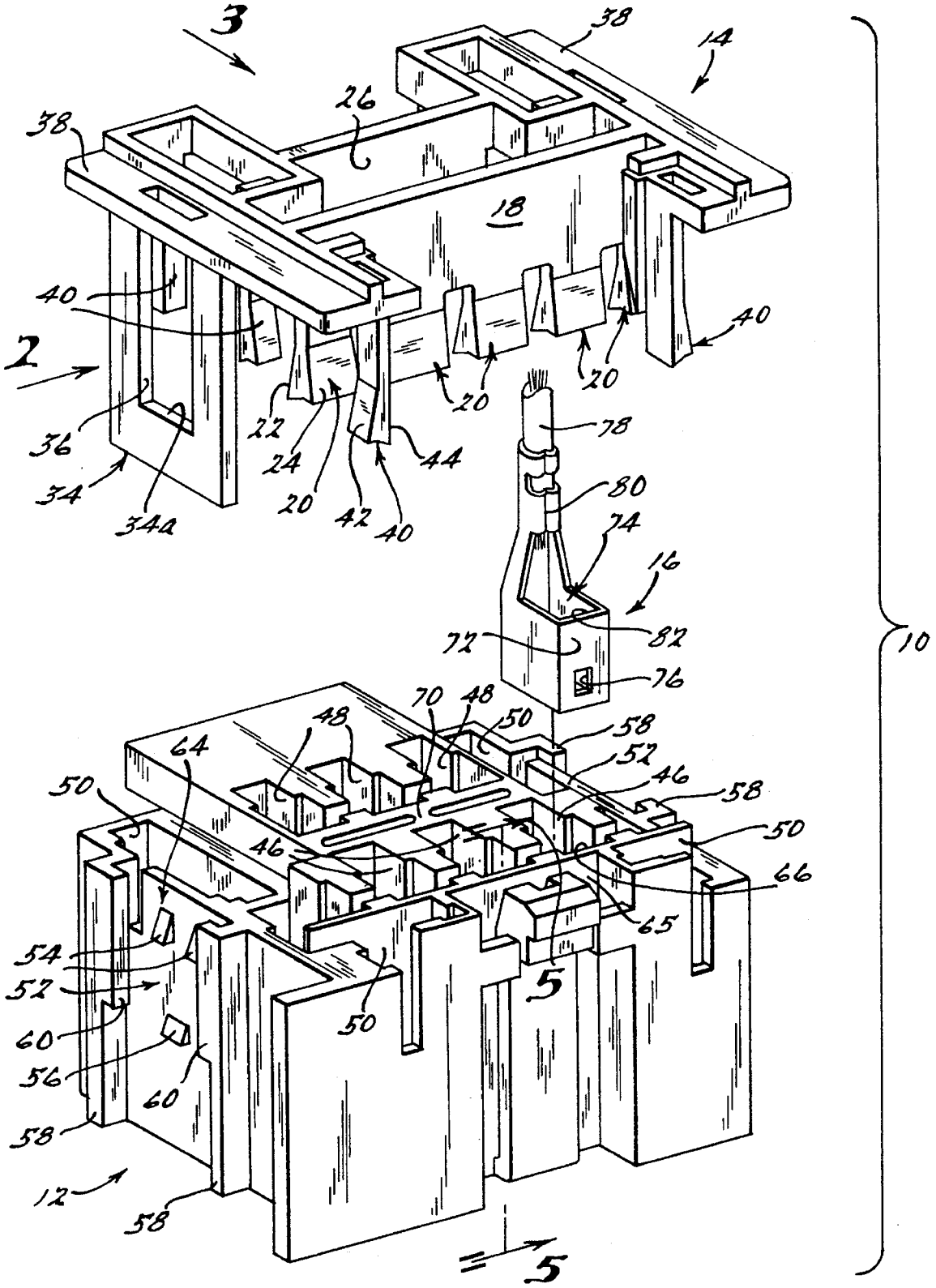
FIG. 1 is an exploded perspective view of a connector assembly in accordance with a preferred embodiment of the present invention.

Referring to FIG. 1, there is shown an electrical connector assembly 10 in accordance with the preferred embodiment of the present invention. The connector assembly 10 generally includes a connector body 12 and a terminal stuffer member 14. An exemplary terminal member 16 is shown with which the connector assembly 10 may be used.

Figure 3:
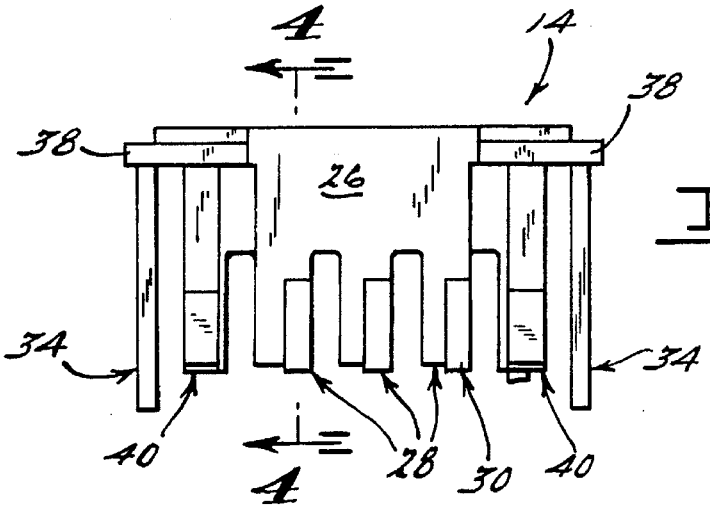
FIG. 3 is a rear view of the terminal stuffer member of FIG. 1 in accordance with directional arrow 3 in FIG. 1.
Figure 4:
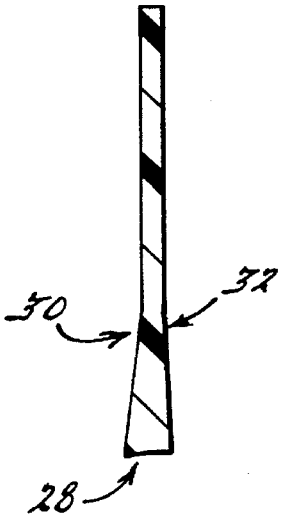
FIG. 4 is a cross sectional side view of one of the locking arm members in accordance with section line 4—4 in FIG. 3.

With further reference to FIG. 1, the terminal stuffer member 14 generally includes a first wall portion 18 having a plurality of depending locking arm members 20. Each of the locking arm members 20 is generally flexible relative to the wall portion 18 and includes a ramped portion 22 on one side thereof and a planar portion 24 on the other side thereof. With particular reference to FIGS. 1, 3 and 4, the preferred embodiments of the connector assembly 10 further include a second wall portion 26 which also includes a plurality of locking arm members 28 depending therefrom and being relatively flexible relative to the second wall portion 26. Each of the locking arm members 28 include a ramped portion 30 on one surface thereof and a generally planar portion 32 on the other side thereof. It will be appreciated, however, that the number of wall portions and the number of locking arm members may vary significantly to suit the needs of specific applications and the number of terminal members 16 to be held within the connector body 12. Thus, the connector assembly 10 could be adapted for use with as few as one locking arm member 20 when only one terminal member 16 is to be secured within the connector body 12. Conversely, while only two wall portions 18 and 26 have been illustrated, it will be appreciated that a greater or lesser plurality of wall portions 18,26 could readily be included depending upon how many rows of terminal members 16 are to be secured within the connector body 12. Thus, if three rows of terminal members 16 are to be secured, then three wall portions may be included with each having a plurality of locking arm members depending therefrom. It will also be appreciated that while the wall portions 18 and 26 have been shown extending generally parallel to one another, that the wall portions 18,26 could be formed perpendicular to one another or at any other angle as needed to suit the needs of a particular application. It is anticipated, however, that the most efficient arrangement will be that, or similar to that, disclosed herein where the terminal stuffer member 14 includes a plurality of generally parallel extending wall portions.

Figure 2:
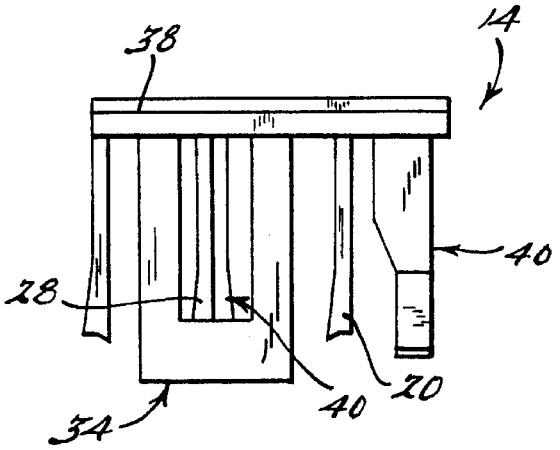
FIG. 2 is an end view of the terminal stuffer member in accordance with directional arrow 2 in FIG. 1.

With further reference to FIGS. 1–3, the terminal stuffer member 14 includes a pair of flexible latching arm members 34 protruding outwardly therefrom on opposing end portions of the terminal stuffer member 14. Each of the latching arm members 34 forms an opening 36 (FIG. 1) and is at least slightly flexible relative to a top member 38 from which it depends. It will also be appreciated that while only two latching arm members 34 have been illustrated, a greater or lesser plurality may be included at various portions of the terminal stuffer member 14 if so desired. An opposing pair of the latching arm members 34, however, has been found to work extremely well in lockably securing the terminal stuffer member 14 to the connector body 12, as will be explained in more detail momentarily.

With continued reference to FIGS. 1–3, an additional plurality of locking arm members 40 may be formed integrally with the top members 38 to further increase the number of terminal members 16 which may be secured by the terminal stuffer member 14. It will be appreciated that each of the optional locking arm members 40 is generally flexible relative to the top member 38 and includes a ramped portion 42 and a generally planar portion 44 similar or identical to the locking arm members 20 and 28.

With reference to FIG. 1, the connector body 12 will now be described. The connector body 12 includes a first plurality of openings 46, a second plurality of openings 48 and an optional plurality of openings 50 into which terminal members such as terminal member 16 may be slidably inserted. The first plurality of openings 46 is formed in a row and spaced so as to be adapted to be in alignment with the locking arm members 20 when the terminal stuffer member 14 is secured to the connector body 12. Similarly, the second plurality of openings 48 form a row which is in general alignment with the locking arm members 28 depending from the second wall portion 26. The optional third plurality of openings 50 at the four corners of the connector body 12 are in general alignment with the optional locking arm members 40.

With further reference to FIG. 1, the connector body 12 includes a pair of side wall portions 52 which each include a first pair of protruding shoulder portions 54 and a second protruding shoulder portion 56. Each of the side wall portions 52 further includes a pair of integrally formed guide members 58 which each have an over-hanging shoulder member 60 integrally formed therewith. The guide members 58, the over-hanging shoulder portions 60 and the side wall portion 52 on each side of the connector body 12 form a channel 64 on each side of the connector body 12 which is adapted to receive the latching arm members 34 of the terminal stuffer member 14 when the member 14 is slidably engaged with the connector body 12.

Figure 5:
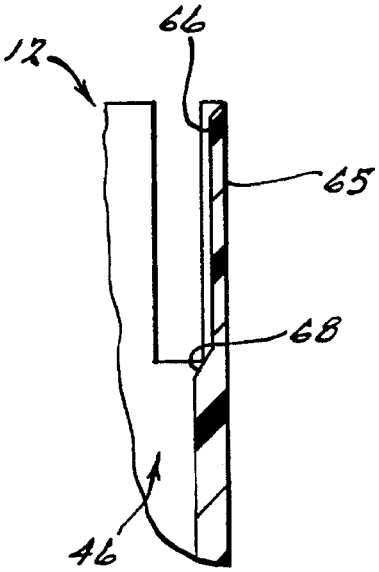
FIG. 5 is a cross sectional side view of a portion of the connector body, in accordance with section line 5—5 in FIG. 1.

With further reference to FIGS. 1 and 5, the connector body 12 includes a wall portion 65 having a plurality of recessed portions 66 formed in alignment with the first plurality of openings 46. With specific reference to FIG. 5, each of the recessed portions 66 includes a ramp portion 68 associated therewith. A wall portion 70 (FIG. 1) similarly includes a plurality of recess portions (not shown) formed in alignment with the second plurality of openings 48, with each of the recessed portions having a ramp portion (not shown) associated therewith. It will be appreciated that the recessed portions and ramped portions formed on the wall portion 70 are identical in configuration to those formed on the wall portion 65; therefore, only the functions of the recessed portions 66 and their corresponding ramp portions 68 relative to the terminal stuffer member 14 will be described. In a similar manner, it will be appreciated that each of the optional openings 50 includes a recessed portion and a ramp portion identical to portions 66 and 68, which have been shown in perspective to even further help illustrate the intercoupling of the terminal stuffer member 14 and the connector body 12.

With continued reference to FIG. 1, each of the plurality of openings 46, 48 and 50 are shaped complimentarily to the terminal member 16 so as to enable the terminal member 16 to be readily slidably inserted within one of the openings 46, 48 or 50. Of course, it will be appreciated that if a plurality of terminal members having different configurations (i.e., different cross sectional shapes) is to be secured within the connector body 12, then the connector body 12 will require a corresponding plurality of differently shaped openings. The terminal member 16 illustrated in FIG. 1, merely as an example, is of a generally rectangular configuration having a main body portion 72 which forms an opening 74 into which an external terminal blade (not shown) may be inserted once the terminal member 16 is lockably seated within the connector body 12. The main body portion 72 further includes an aperture 76 formed therein, the function of which will be described momentarily. A terminal end of an electrical conductor 78 is typically crimped onto a neck portion 80 of the terminal member 16 to thereby electrically couple the terminal member 16 to an external electrical circuit, device, etc.

Figure 6:
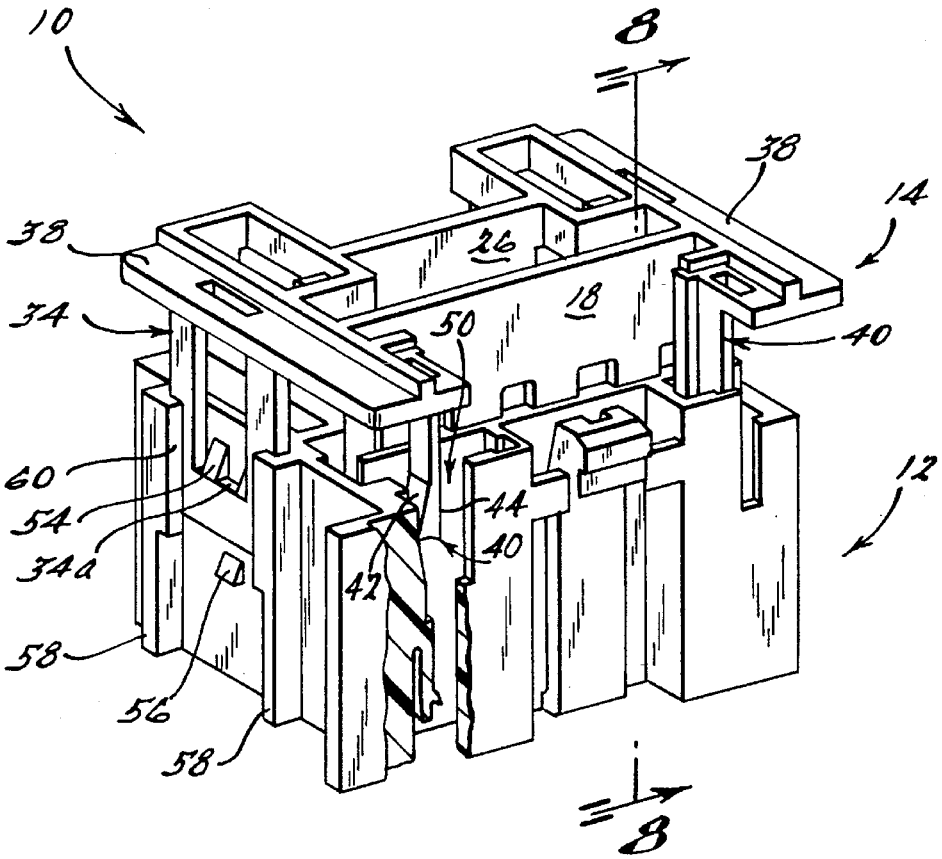
FIG. 6 is a perspective view of the connector assembly showing the terminal stuffer member engaged with the connector body in the first, pre-loaded position, and further showing, via a broken-away corner portion, how one of the locking arm members engages within one of the openings.
Figure 7:
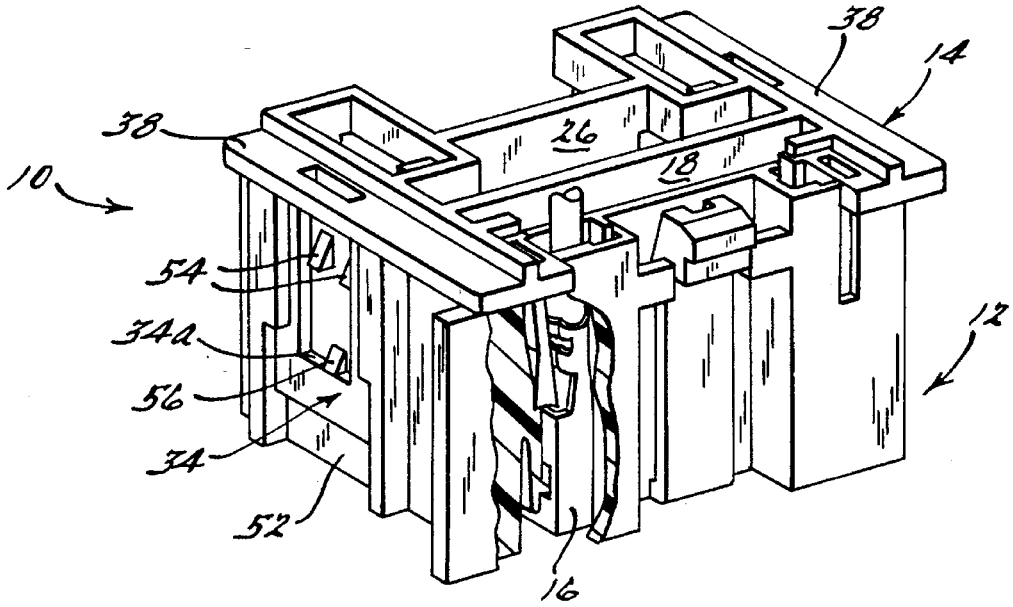
FIG. 7 is a perspective view of the connector assembly of FIG. 6 showing the terminal stuffer member in its second, fully locked position.
Figure 8:
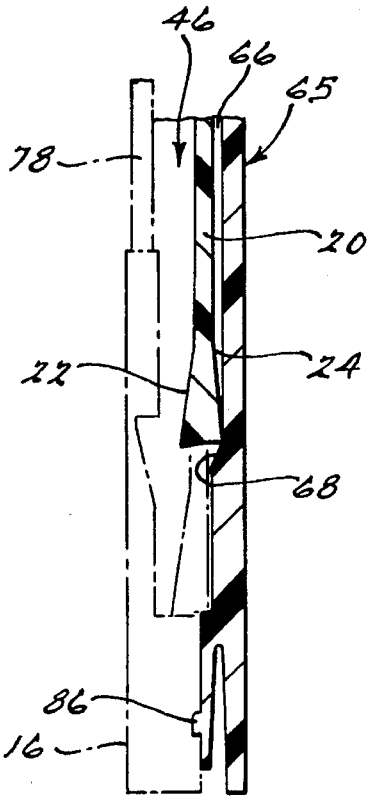
FIG. 8 is a side view of a portion of the connector body illustrating one of the recessed portions formed therein and its associated ramped portion, and also illustrating in cross section one of the locking arm members in the first, preloaded position, and in phantom how the locking arm member engages a terminal member, also shown in phantom.

Referring now to FIGS. 1, 6 and 8, the terminal stuffer member 14 is slidably engaged with the connector body 12 into a first, preloaded position as shown in FIGS. 6 and 8. In this position the planar portions 24 of each of the locking arm members 20, the planar portions 32 of the locking arm members 32 and the planar portions 44 of the optional locking arm members 40 abuttingly engage their associated recessed portions and a portion of each wall portion 18 and 26 extends within the openings 46 and 48. In an identical manner, the planar portions 32 of the locking arm members 28 abuttingly engage the recessed portions (now shown) in the wall portion 70 of the connector body 12. If the optional locking arm members 40 have been included, then their planar portions 44 are disposed within the recessed portions formed in the openings 50 of the connector body 12, as shown for purposes of illustration in FIGS. 6 and 7. As shown particularly well in FIG. 8, when in the preloaded position the locking arm members 20 do not interfere with the openings 46, and thus do not interfere with slidable insertion of the terminal member 16 within the openings 46. This applies to all of the arm members 28 and 40. Thus, even with the terminal stuffer member 14 engaged with the connector body 12 in the preloaded position, the terminal member 16 may still be inserted into the openings 46 in the connector body 12.

In the first, preloaded position the latching arm members 34 are slidably engaged within the channel 64 formed by the guide members 58. In this position the latching arm portions each engage with their respective shoulder portions 56, and are prevented from being lifted off of the sidewall portions 52 by the overhanging shoulder members 60 associated with the guide members 58. Thus, the terminal stuffer member 14 is held relatively stationarily engaged with the connector body 12 even in the preloaded position shown in FIGS. 6 and 8.

Referring now to FIG. 7 and 8, when the terminal stuffer member 14 is urged slidably further into a second, locked position, the ramp portions 68 associated with the recessed portions 66 urge the locking arm members 20 towards the openings 46 in the connector body 12. The ramped portions 22 of the locking arm members 20 abuttingly engage an edge portion 82 of each terminal member 16, as shown in phantom in FIG. 8, to thus secure the terminal members 16 securely within their respective openings 46. At this point all of the arm members 28 and 40 are lockably engaged with their respective terminal members. Thus, when a pulling or pushing force is exerted on the terminal member 16 via the conductor 78 or an external terminal blade, the terminal member 16 is still held securely within its respective opening 46 by its associated locking arm member 20.

In the second, locked position, as shown particularly well in FIG. 7, the latching arm members 34 are caused to slide further into the channel 64 and over the shoulder portions 56 (only one shown) on each of the sidewall portions 52. An inner edge portion 34*a* of each latching arm member 34 abuttingly engages with its associated latching arm member 34 and is held against its associated sidewall 52 by the overhanging shoulder members 60. Thus, the terminal stuffer member 14 is held lockably to the connector body 12.

It should also be appreciated that if one or more terminal members 16 are not completely seated within the connector body 12 when first inserted, that urging the terminal stuffer member 14 into its second, locked position will also cause the slightly unseated terminal member(s) 16 to be urged into its fully seated position. In the preferred embodiments the terminal stuffer member 14 operates to fully seat terminal members that are unseated by up to about 6.0 mm.

With brief reference to FIG. 8, it will be noted that the wall portion 18 further includes a relative flexible depending lip portion 84 including a plurality of shoulder portions 86 (only one being shown) which are spaced along the lip portion 84 so as to be generally aligned with the openings 46. When the terminal member 16 is inserted into one of the openings 46, the shoulder portion 86 associated with that particular opening 46 abuttingly engages within the aperture 76 to form a "primary" locking means for securing the terminal member 16 within the opening 46. It will also be appreciated that each opening 48 and 50 in the connector body 12 includes a lip portion and a shoulder portion like that illustrated in FIGS. 6, 7 and 8 for acting as a primary securing means for its associated terminal member 16.

By incorporating the terminal stuffer member 14, the stuffer member 14 provides a secondary means for even more securely maintaining the terminal member 16 within the connector body 12, and without the disadvantage of otherwise interfering with the openings 46 during the assembly process. Thus, there is no additional force required, because of use of the terminal stuffer member 14, to overcome the interference normally otherwise presented by prior designs of stuffer members when inserting the terminal members 16 into their respective openings in the connector body. Accordingly, insertion of the terminal members 16 within the connector body 12 may be performed while the terminal stuffer member 14 is not secured to the connector body 12 or secured in its preloaded position as shown in FIGS. 5, 6 and 8.

Figure 9:
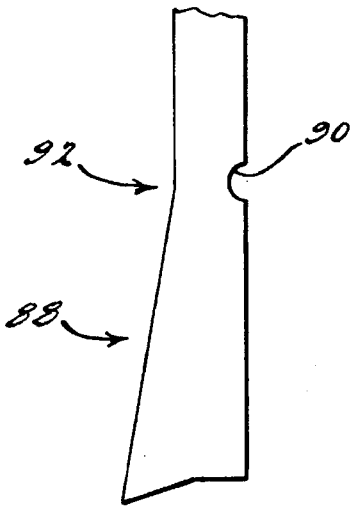
FIG. 9 is a side view of an alternative preferred embodiment of the locking arm member.

Referring now to FIG. 9, an alternative preferred embodiment 88 of the locking arm member 20 shown in FIG. 1 is illustrated. The locking arm member 88 includes a cut-out portion 90 to even further increase the flexibility of the arm member 88. It will be appreciated that while the cut-out 90 has been illustrated as being of a generally semi-circular shape, that a wide variety of other shaped cut-outs may be formed along the length of the locking arm member 88 to increase its flexibility. Alternatively, the cross sectional thickness of the locking arm member 88 in a central portion 92 may be reduced with or without the cut-out portion 90, to increase the flexibility of the arm member 88.

Figure 10:
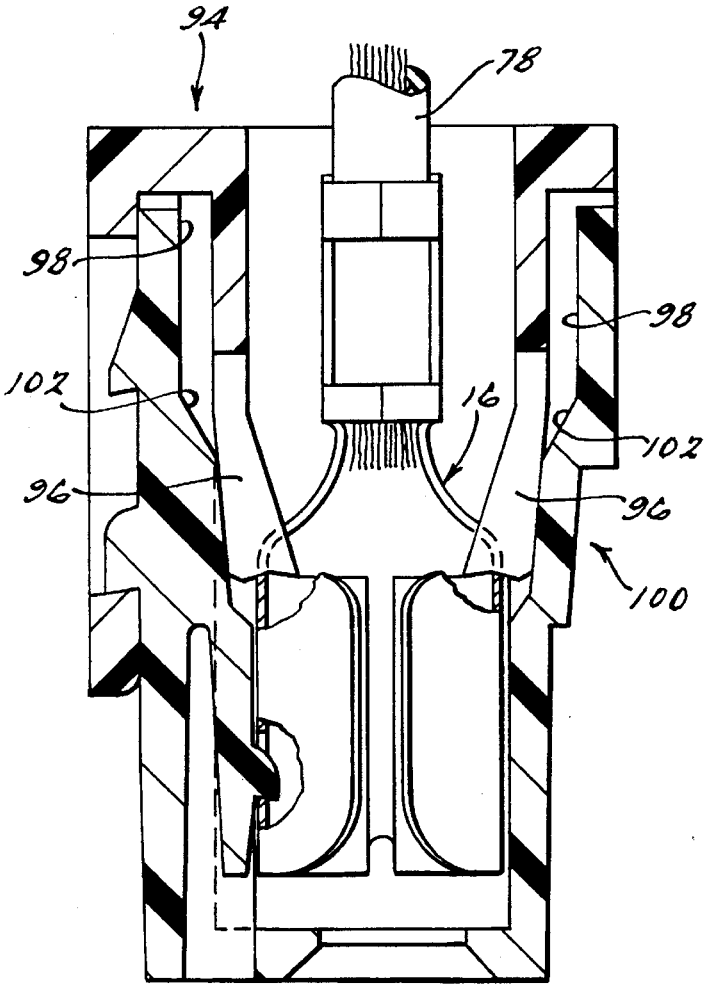
FIG. 10 is a side cross sectional view of an alternative preferred embodiment of a connector assembly in accordance with the present invention showing how a pair of locking arm members of a terminal stuffer member and a corresponding pair of recessed portions and ramped portions of a connector body could be implemented to even more securely hold a terminal member within the connector body.

Referring now to FIG. 10, another alternative preferred embodiment 94 of the terminal stuffer member is shown. This embodiment 94 incorporates a pair of locking arm members 96 formed opposite one another. The locking arm members 96 are adapted to cooperate with a corresponding pair of recessed portions 98 formed on opposing sides of an alternative preferred connector body 100. The connector body 100 includes ramp portions 102 which urge the locking arm members 96 towards the terminal member 16 to thereby even more securely hold the terminal member 16 within the connector body 100. It will be appreciated that a plurality of even more than two locking arm members 96 could be included if even more secure engagement of the terminal member 16 within the connector body 100 is needed.

The preferred embodiments of the present invention described herein all provide even more secure engagement of a terminal member within a connector body without requiring the assembly process of the terminal members 16 within the connector body to be altered. Accordingly, terminal members may be slidably inserted within the connector body, even after the terminal stuffer member of the present invention is secured to the connector body, without requiring additional force to be exerted when inserting the terminal members. The preferred embodiments of the connector assembly described herein may be formed from widely practiced manufacturing techniques such as injection molding, and may be manufactured from a wide variety of materials such as plastic.

The preferred embodiments of the present invention thus form a relatively inexpensive, generally lightweight yet strong connector assembly which is well adapted to a wide variety of applications, and particularly to automotive applications where a relatively large number of terminal members associated with a vehicle wiring harness must be secured via some form of electrical connector to various components of a vehicle. It will be appreciated, however, that while the apparatus of the present invention is particularly well suited to automotive applications, it is readily adaptable with little or no modification to a wide variety of other applications, and virtually to any other application in which two or more electrical conductors must be releasably coupled together.

Those skilled in the art can now appreciate from the foregoing description that the broad teachings of the present invention can be implemented in a variety of forms. Therefore, while this invention has been described in connection with particular examples thereof, the true scope of the invention should not be limited since other modifications will become apparent to the skilled practitioner upon a study of the drawings, specification and following claims.

What is claimed is:

1. An electrical connector assembly comprising:

a connector body having at least first and second openings adapted to receive first and second terminal members therein which are oriented substantially normal to one another, said connector body including at least first and second wall portions and ramps on said wall portions; and a terminal stuffer member adapted to interengage with said connector body for securing said terminal members within said openings, said terminal stuffer member including an integrally formed planar wall portion having a first flexible arm member formed integrally therewith and protruding therefrom, said first flexible arm member being adapted to be urged into abutting engagement with said first terminal member when said first terminal member is disposed within said opening in said connector body and said terminal stuffer means is operably engaged with said connector body;

said terminal stuffer member including a second flexible arm member protruding therefrom and oriented substantially normal with respect to said first arm member, said second arm member being flexible and being adapted to be urged into abutting engagement with said second terminal member;

whereby interengagement of said terminal stuffer member with said connector body when said first and second terminal members are disposed within said opening in said connector body causes said flexible arm members to be urged by said ramp into abutting engagement with said terminal members, to thereby lockably secure said terminal members within said connector body; and whereby said terminal stuffer member may be interengaged with said connector body in a preloaded position in which said flexible arm member does not interfere with insertion of said terminal members into said openings.

2. The connector assembly of claim 1, further comprising:

latch means for lockably securing said terminal stuffer member to said connector body.

3. The connector assembly of claim 2, wherein said latch means comprises a flexible latching arm member on said terminal stuffer member; and a protruding shoulder portion on said connector body, said flexible latching arm member being adapted to abuttingly interengage said protruding shoulder portion once said terminal stuffer member is interengaged with said connector body to thereby prevent said terminal stuffer member from being removed from said connector body.

4. The connector assembly of claim 3, further comprising:

guide means associated with said connector body for receiving said flexible latching arm member when said terminal stuffer member is interengaged with said connector body to thereby help align said terminal stuffer member as said terminal stuffer member is secured to said connector body.

5. The connector assembly of claim 1, wherein said flexible arm member includes a ramped portion for abuttingly engaging with a portion of said terminal member when said terminal stuffer member is lockably secured to said connector body.

6. A connector assembly comprising:

a connector body having a plurality of openings formed therein adapted to receive a corresponding plurality of independent terminal members slidably therein;

said connector body further including a wall portion defining first and second pluralities of recessed portions, each one of said recessed portions including a ramped portion associated therewith, said second plurality of recessed portions being oriented substantially normal with respect to said first plurality of recessed portions; and a terminal stuffer member for lockably securing said terminal members within said connector body;

said terminal stuffer member including an integrally formed planar wall portion including a first and second pluralities of flexible arm members adapted to fit within said recessed portions in said connector body when said terminal stuffer member is engaged with said connector body to a first, preloaded position, said second plurality of flexible arm members being oriented substantially normal with respect to said first plurality of flexible arm members;

said terminal stuffer member further not interfering with said openings formed in said connector body when positioned at said first, preloaded position so as to enable insertion of said terminal members into said openings within said connector body; and said flexible arm members being caused to be urged toward said openings in said connector body by said ramped portions when said terminal stuffer member is urged into a second, locked position relative to said connector body;

said terminal stuffer member, when in said second, locked position, operating to lockably secure said plurality of terminal members within said openings in said connector body by abutting engagement of said flexible arm members with said terminal members.

7. The connector assembly of claim 6, further comprising a pair of latching members operably associated with said terminal stuffer member for securing said terminal stuffer member to said connector body; and at least one pair of protruding shoulder portions operably associated with said connector body;

said pair of latching members being adapted to lockably interengage with said protruding shoulder portions to lockably secure said terminal stuffer member to said connector body when said terminal stuffer member is urged into said second, locked position.

8. The connector assembly of claim 6, wherein each said arm portion includes a ramped portion for abuttingly engaging with a portion of an associated one of said terminal members.

9. The connector assembly of claim 7, further comprising a pair of guide members associated with said connector body for guiding said latching members into engagement with said connector body when said terminal stuffer member is secured to said connector body.

10. The connector assembly of claim 9, wherein said guide members form a channel; and wherein said latching member comprises a pair of flexible latching arm members adapted to be slidably received within said channel as said terminal stuffer member is slidably engaged with said connector body.

11. The connector assembly of claim 6, wherein said terminal stuffer member includes a wall portion from which said arm portions depend, a portion of said wall portion being adapted to be inserted within said connector body when said terminal stuffer member is lockably secured to said connector body.

12. A connector assembly comprising:

a connector body;

said connector body including first and second pluralities of openings formed therein for receiving a corresponding plurality of complimentarily shaped terminal members slidably therein, a wall portion including a corresponding plurality of recessed portions with each one of said recessed portions including a ramp portion, said second plurality of opening being oriented substantially normal with respect to said first plurality of openings;

a terminal stuffer member including an integrally formed planar wall portion having first and second pluralities of locking arm members depending therefrom, corresponding in number to said respective first and second pluralities of openings in said connector body and said locking arm portions being at least slightly flexible, said second plurality of locking arm members being oriented substantially normal with respect to said first plurality of locking arm members;

said terminal stuffer member being adapted to be inserted slidably within said connector body such that said planar wall portion is positioned adjacent said recessed portions such that said locking arm members are slidably received within said recessed portions when said terminal stuffer member is slidably coupled to said connector body to a first, preloaded position, wherein in said first, preloaded position, said locking arm members do not interfere with insertion of terminal members within said openings in said connector body; and when said terminal stuffer member is slidably engaged with said connector body to a second, fully locked position, said ramp portions associated with said recessed portions urge said locking arm members toward said openings in said connector body and into abutting engagement with portions of said terminal members inserted within said openings, to thereby lockably secure said terminal members within said connector body.

13. The connector assembly of claim 12, further comprising latching means for lockably securing said terminal stuffer member to said connector body such that said terminal stuffer member is not uncoupled from said connector body when an external force is applied to at least one of said terminal members.

14. The connector assembly of claim 13, wherein said latching means comprises:

a flexible arm member associated with said terminal stuffer member on opposing end portions of said terminal stuffer member; and a pair of protruding shoulder portions formed on said connector body;

said flexible arm members latchingly engaging said protruding shoulder portions when said terminal stuffer member is slidably engaged with said connector body into said second, locked position.

15. The connector assembly of claim 14, further comprising guide means associated with said connector body for receiving said flexible arm members and guiding said flexible arm members along said connector body as said terminal stuffer member is slidably engaged with said connector body, to thereby help align said terminal stuffer member during slidable engagement with said connector body.

16. The connector assembly of claim 12, wherein each said locking arm member includes a ramped portion facing towards its associated said opening in said connector body, said ramped portion of each said locking arm member being adapted to abuttingly engage a portion of an associated terminal member inserted within said opening to thereby help secure said terminal member within said connector body when said terminal stuffer member is lockably secured to said connector body.

17. A connector assembly comprising:

a connector body;

said connector body having first and second pluralities of openings formed therein and a wall portion facing said openings, said wall portion including a plurality of recessed portions formed therein with each said recess portion including a ramp portion formed therein, each one of said ramp portions being in alignment with an associated one of said openings, said second plurality of openings being oriented substantially normal with respect to said first plurality of openings;

first and second pluralities of terminal members corresponding in number to said first and second pluralities of openings in said connector body and shaped complimentarily to said openings in said connector body so as to be slidably insertable within said openings; and a terminal stuffer member adapted to be slidably engaged with said connector body to lockably secure said terminal members within said openings in said connector body;

said terminal stuffer member having an integrally formed planar wall portion having first and second pluralities of depending locking arm members, each said locking arm member being at least slightly flexible and being formed so as to be slidably insertable within said connector body so as to extend within an associated said one of said recessed portions in said connector body, said second plurality of locking arm members being oriented substantially normal with respect to said first plurality of locking arm members, said ramp portion of each said recessed portion operating to urge its associated locking arm member towards said terminal member as said terminal stuffer member is urged into complete engagement with said connector body.

18. The connector assembly of claim 17, wherein said terminal stuffer member further includes a pair of flexible latching arm members projecting from opposing end portions of said terminal stuffer member; and wherein said connector body includes at least one pair of protruding shoulder portions formed thereon for lockably engaging with said flexible latching arm members to thereby lockably secure said terminal stuffer member to said connector body such that an external force applied to any one of said terminal members does not cause disengagement of said terminal stuffer member from said connector body.

19. The connector assembly of claim 18, further comprising a pair of guide members integrally formed on said connector body for forming a channel for receiving at least a portion of each said flexible latching arm member therein to thereby help guide said terminal stuffer member into locking engagement with said connector body when said terminal stuffer member is slidably engaged with said connector body.

20. The connector assembly of claim 19, wherein said guide members each include an overhanging shoulder portion for preventing each said flexible latching arm member from being urged outwardly of said connector body once said terminal stuffer member is completely slidably engaged with said connector body.

* * * * *